US005641164A

United States Patent [19]

Doederlein et al.

[11] Patent Number: 5,641,164

[45] **Date of Patent: *Jun. 24, 1997**

[54] TALKING TRADING CARDS

[75] Inventors: Dieter D. Doederlein, Mississauga; G. Dale Newman, Unionville; Brian J. Burgess, Newmarket; Anthony C. Sharp, Agincourt, all of Canada

[73] Assignee: The M2000 Group Inc., Richmond Hill, Canada

[ * ] Notice: The term of this patent shall not extend beyond the expiration date of Pat. No. 5,480,156.

[21] Appl. No.: 433,851

[22] Filed: May 2, 1995

Related U.S. Application Data

[63] Continuation-in-part of Ser. No. 322,135, Oct. 13, 1994, Pat. No. 5,480,156.

[51] Int. Cl.[6] ..... G09F 1/00

[52] U.S. Cl. ..... 273/237; 40/457; 40/455; 40/442

[58] Field of Search ..... 273/237; 40/455; 446/397

[56] References Cited

U.S. PATENT DOCUMENTS

| | | | |
|---|---|---|---|
| 3,691,312 | 9/1972 | Peterson | 273/237 |
| 3,798,806 | 3/1974 | Sanford | 273/237 |
| 3,857,191 | 12/1974 | Sadorus | 273/237 |
| 4,531,310 | 7/1985 | Acson et al. | 273/237 |
| 4,551,114 | 11/1985 | Hyman et al. | 446/397 |
| 4,607,747 | 8/1986 | Steiner | 273/237 |
| 4,703,573 | 11/1987 | Montgomery et al. | 273/237 |
| 4,791,741 | 12/1988 | Kondo | 273/237 |
| 4,807,294 | 2/1989 | Iwata et al. | 273/237 |
| 4,866,865 | 9/1989 | Yang | 273/237 |
| 4,934,079 | 6/1990 | Hoshi | 273/237 |
| 4,969,197 | 11/1990 | Takaya | 273/237 |
| 5,010,665 | 4/1991 | Clinkscales | 273/237 |
| 5,030,485 | 7/1991 | Meeks et al. | 273/237 |
| 5,031,222 | 7/1991 | Takaya | 273/237 |
| 5,063,698 | 11/1991 | Johnson et al. | 273/237 |
| 5,182,872 | 2/1993 | Lee et al. | 273/237 |
| 5,196,755 | 3/1993 | Shields | 273/237 |
| 5,275,285 | 1/1994 | Clegg | 273/237 |
| 5,433,035 | 7/1995 | Bauer | 273/237 |
| 5,480,156 | 1/1996 | Doederlein et al. | 273/237 |

*Primary Examiner*—Vincent Millin
*Assistant Examiner*—Charles W. Anderson
*Attorney, Agent, or Firm*—Bereskin & Parr

[57] ABSTRACT

A trading card capable of generating sounds comprises a thin housing having front and back surfaces, flexible sheets affixed to the front surface and to the back surface of the housing, a voice chip located in the housing for generating patterns of sounds, a battery located in the housing for supplying electrical power to the voice chip, and a switch located in the housing for activating the voice chip. The trading card preferably has a piezoelectric driver coupled to a foam sound board for increasing the volume of sound. The subject trading card may be activated by squeezing the flexible sheets between the thumb and forefinger at a selected switch location.

17 Claims, 4 Drawing Sheets

TALKING TRADING CARDS

This application is a continuation-in-part of application Ser. No. 08/322,135, filed Oct. 13, 1994, now U.S. Pat. No. 5,480,156.

BACKGROUND OF THE INVENTION

This invention relates to collectable cards, and in particular, sports trading cards such as baseball cards, hockey cards and the like.

Baseball cards and other sports trading cards have been available since the turn of the century. These cards typically display an action photograph or other image of a baseball player or other athlete on the front face, and statistics and other personal information about the player on the back face. Collecting and trading baseball cards and other sports cards is a popular hobby engaged in by both children and adults. Sports cards tend to appreciate in value over the years, with rare cards such as the 1909 Honus Wagner baseball card being valued at several hundred thousand dollars.

In recent years, collecting sports cards has increased in popularity, particularly among younger collectors. Card manufacturers have responded to this increase in popularity by introducing innovations such as holographic logos and gold-plated collector sets. However, conventional sports trading cards are passive, and the information provided thereon has remained relatively constant over the years. The present inventors have recognized a need and demand for sports cards which provide more information and value than that available on conventional passive sports cards.

SUMMARY OF THE INVENTION

The present invention is accordingly directed to an active trading card which provides not only graphics and text, but also sounds, such as a player's voice. The subject invention not only increases the information provided by sports cards, but also increases their appeal to collectors, particularly adults.

The subject trading card comprises a thin housing having front and back surfaces, flexible sheets affixed to the front and back surfaces, sound generating means located in the housing for generating preselected patterns of sounds, power means located in the housing for supplying electrical power to the sound generating means, and activation means located in the housing for activating the sound generating means.

In a preferred embodiment, the subject invention includes activation means in the form of a snap switch sandwiched between the front and back flexible sheets which can be activated merely by squeezing the sheets between the thumb and index fingers. This construction eliminates the need for an unsightly switch button which protrudes beyond the flat front face of the card. The subject switch also allows the entire front and back faces of the card to be filled with graphics or text.

The subject trading card also preferably utilizes a long-life replaceable battery mounted in a battery cavity covered by a battery cap which fits along one edge of the card. This battery cavity construction eliminates the need for cutouts, flaps or other battery door on the face of the card, thereby enabling the entire front and back faces of the card to be used for decoration. It also bestows the "collectable" property upon the active card by providing indefinite life through replacement of the battery without disturbing the front or back sheets.

In a presently preferred embodiment, the subject card includes piezoelectric speaker means comprising a piezoelectric driver coupled to a sound board. The sound board is preferably a stiff planar foam sheet with an aperture therein aligned with the piezoelectric driver. The diameter of the aperture therein may be dimensioned to receive the piezoelectric driver. The piezoelectric driver is preferably coupled to the sound board by thin flexible adhesive tape. The trading card also comprises a housing divided into a speaker sub-housing having a means for supporting the sound board along the outer perimeter thereof, and an electronics sub-housing. The sound board support means is preferably a thin frame having a notch in the inner edge dimensioned for receiving the outer edges of the sound board.

The subject talking trading card has an unusually thin profile, in the range of 2 to 3 min. The card employs a voice chip which reproduces sound of unusually good quality, considering the small dimensions of the card. The trading card of the subject invention is also relatively simple and inexpensive.

DETAILED DESCRIPTION OF THE PREFERRED EMBODIMENTS

Figure 1:
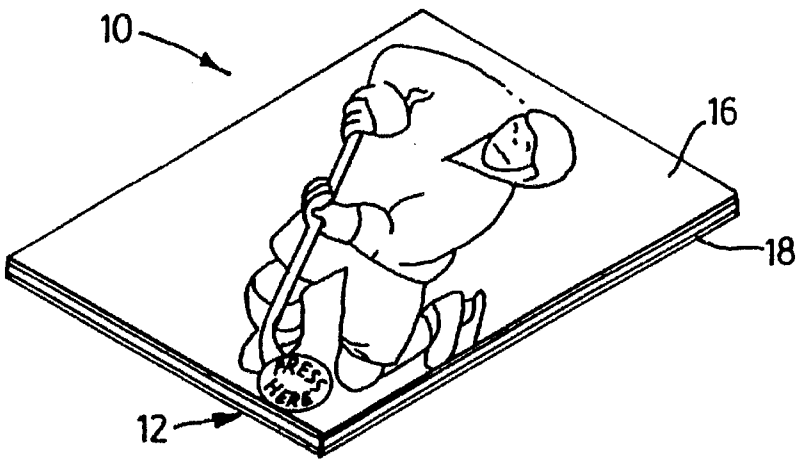
FIG. 1 is a perspective view of a preferred embodiment of a trading card made in accordance with the subject invention.

As shown in FIG. 1, in a preferred embodiment, the subject talking trading card 10 comprises a thin rectangular housing shown generally as 12 having thin flexible sheets 16, 18, adhesively affixed to the front and back surfaces of housing 12. Sheets 16, 18 are preferably card stock or other flexible substrates suitable for printing. Typically, front sheet 16 is printed with a reproduction of a color photograph or other image of the sports player featured on the card, and back sheet 18 is printed with statistics and other personal information about the player.

Referring now to FIGS. 2–5, the front surface of housing 12 comprises a flat front panel 20, and the back surface of housing 12 comprises a thin narrow frame 22 extending outwardly from the back of front panel 20 around the periphery thereof.

The dimensions of front panel 20 are preferably equal to the dimensions of conventional sports trading cards, i.e. 2.5 by 3.5 inches. The thickness of housing 12 is preferably in the range of 2 to 3 mm.

Figure 5:
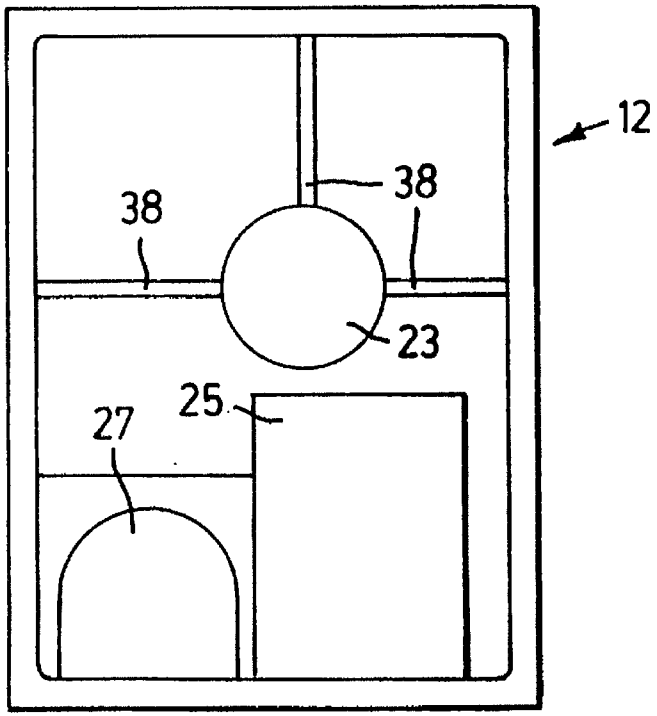
FIG. 5 is a bottom plan view of the housing of the preferred embodiment.

As shown in FIG. 5, front panel 20 of housing 12 is provided with circular aperture 23 approximately in the middle thereof for receiving speaker 24, a rectangular aperture 25 for receiving printed circuit board 26 and a generally rectangular battery aperture 27 having a rounded inside edge for receiving battery 28. Housing 12 preferably includes reinforcing ribs 38 which extend outwardly from the back of front panel 20, to provide some rigidity to housing 12.

Figure 2:
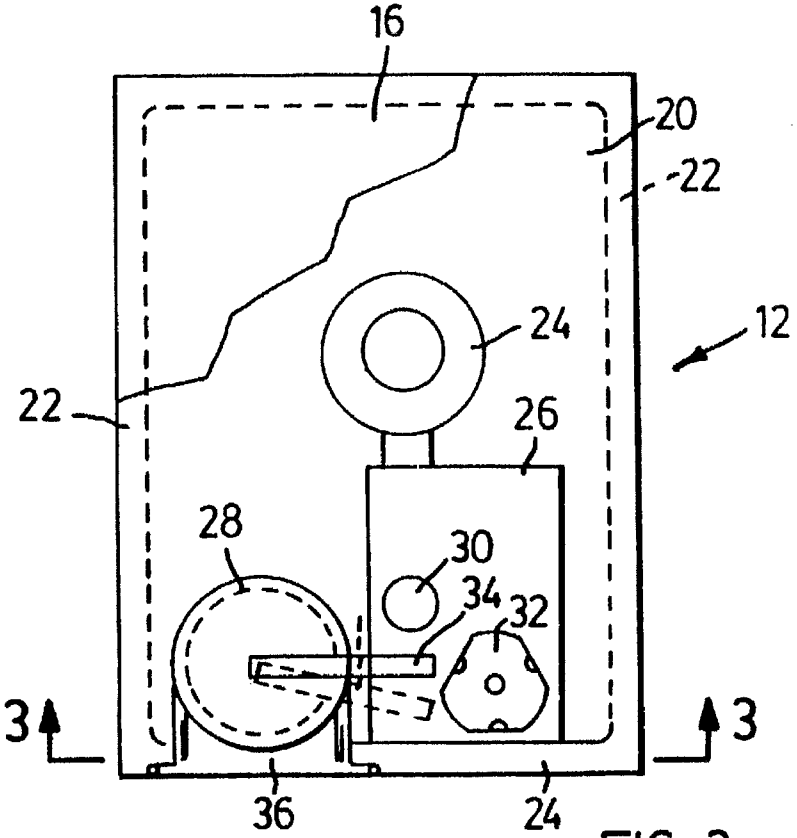
FIG. 2 is a partially cut-away top plan view of the preferred embodiment.
Figure 3:
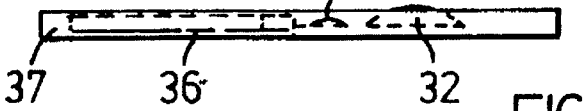
FIG. 3 is a sectional view taken along lines 3—3 in FIG. 2.
Figure 4:
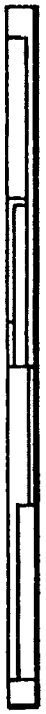
FIG. 4 is a sectional view taken along lines 4—4 in FIG. 2.

As best shown in FIG. 2, the sound generating means of the subject invention comprises speaker 24 and voice chip 30 mounted on a printed circuit board 26. Snap switch 32 mounted on printed circuit board 26 activates voice chip 30. Battery 28 provides electrical power to printed circuit board 26 by means of spring loaded battery contacts 34. Battery cap 36 is a plastic plug which is shaped to fit in the mouth of battery aperture 27 along the bottom side edge 37 of housing 12.

Voice chip 26 may be a single chip integrated circuit utilizing VLSI technology, comprising a 360K ROM for voice data storage, adapted to be powered by a power supply in the range of 2.4 volts to 5.0 volts. Voice chip 26 is preferably capable of providing voice or other sound output of approximately 10–90 seconds long at 5K sampling rate. Battery 28 is preferably a thin circular 3 volt manganese oxide/lithium battery, which has a multi-year lifetime in this application under normal usage. Snap switch 32 preferably comprises a resilient dome-switch contact plate which comes into contact with a second plate when finger pressure is applied thereto.

Voice chip 26 generates a preselected output signal which recreates the sports player's voice or other recognizable voice or sound recording related to the person being featured on the card. Voice chip 26 is programmed by the voice chip manufacturer, using a sound recording stored on an audio tape or the like. This sound recording is digitized by the manufacturer, using a sampling rate of 5K or the like, and stored in the voice chip's ROM storage.

Figure 6:
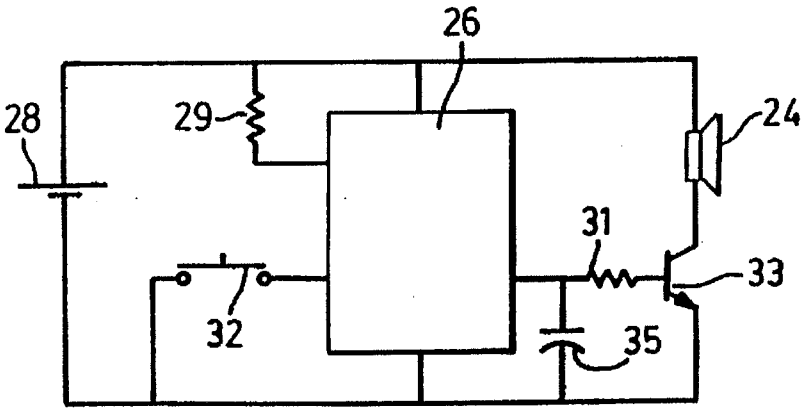
FIG. 6 is a simplified circuit diagram of the electrical components of the preferred embodiment of the subject invention.

Referring now to FIG. 6, battery 28 and resistor 29 maintain voice chip 26 at a 3 V input voltage. Resistor 31, transistor 33 and capacitor 35 drive speaker 24 with an output signal from voice chip 26.

In operation, the voice chip 26 is activated by squeezing flexible sheets 16, 18 at the switch location, designated by a suitable message on front sheet 16, such as "Press Here". Switch 32 closes the circuit shown in FIG. 6, thereby drawing current from battery 28 to voice chip 26. The output of voice chip 26 is converted into an analogue signal and amplified by electrical components 31, 33 and 35 to drive speaker 24, and thereby generate sounds. When the output voice signal is completed, voice chip 26 automatically shuts off. The current drawn by voice chip 26 during its quiescent state is low enough that battery 28 should last for many years. Further, the battery replacement feature makes the subject trading card capable of generating sounds for an indefinite period of time.

Figure 7:
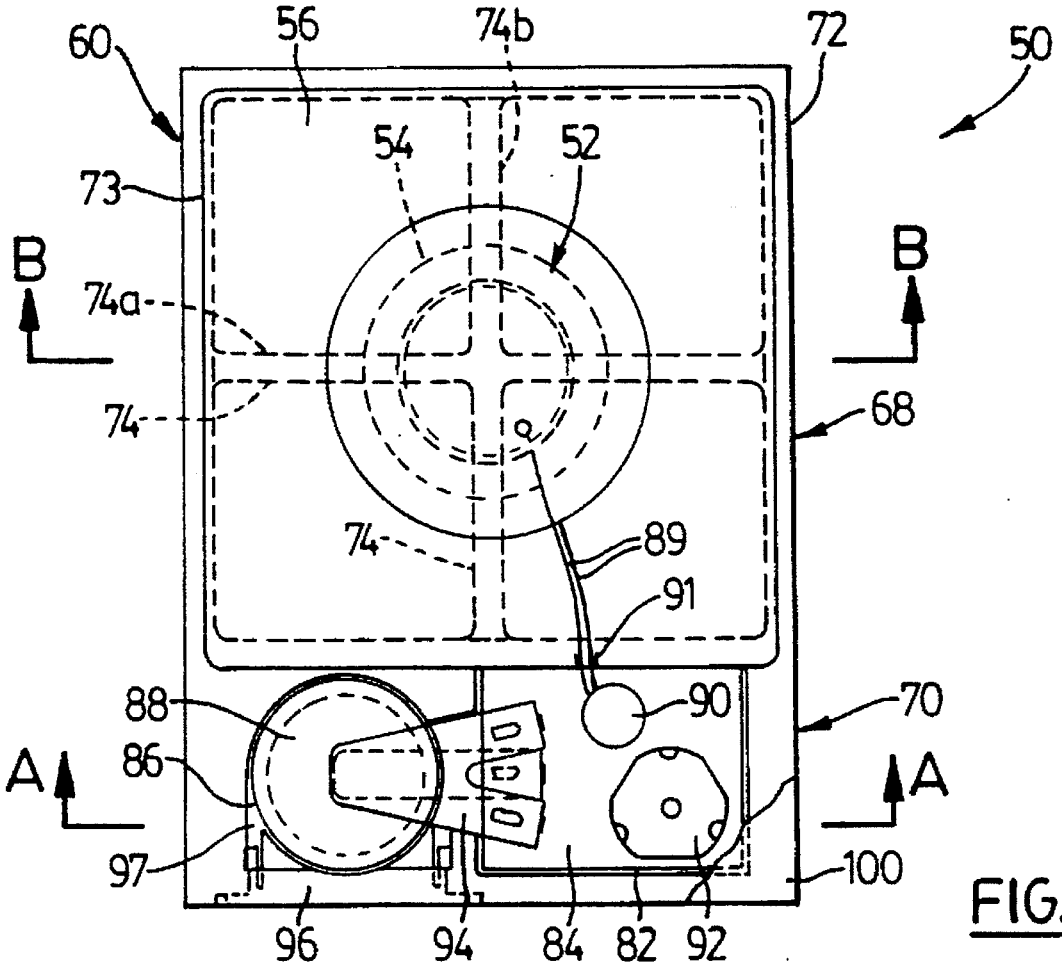
FIG. 7 is a partially cut-away top plan view of the front side of the currently preferred embodiment of the invention.
Figure 8:
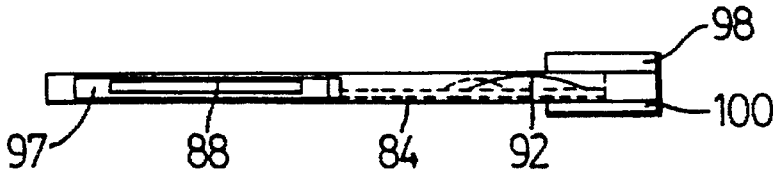
FIG. 8 is a sectional view taken along line A—A of FIG. 7.
Figure 9:
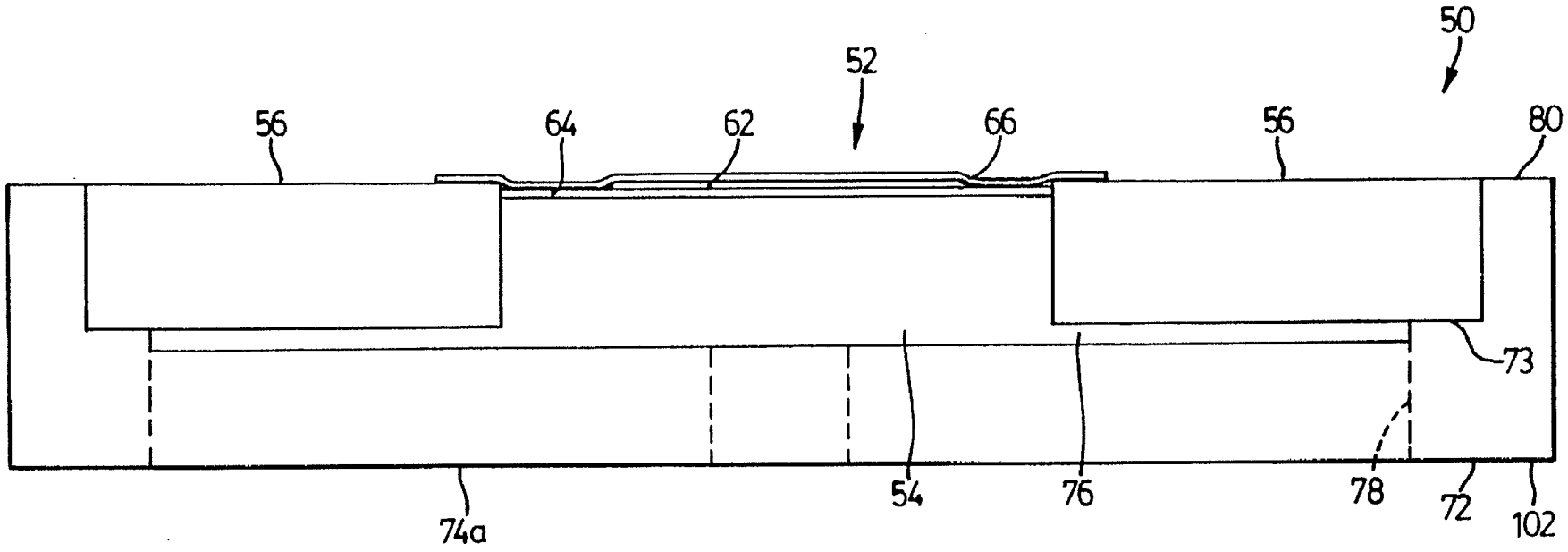
FIG. 9 is a sectional view taken along line B—B of FIG. 7.

Referring now to FIGS. 7–9, in a presently preferred embodiment, the subject talking trading card 50 comprises sound generating means in the form of piezoelectric driver 52 rigidly coupled to sound board 56.

As best shown in FIG. 9, piezoelectric driver 52 preferably comprises a piezoelectric ceramic disc 62 adhering to a central portion of a thin metal disc 64. Sound board 56 is a stiff planar foam sheet having a circular aperture 54 centered therein for receiving piezoelectric driver 52. Sound board 56 may be made from expanded polystyrene or other light and stiff foam material such as urethane resin foam, urea resin foam, or phenolic resin foam.

Driver 52 is preferably mounted in a circular aperture 54 in sound board 56 having a diameter nominally equal to the diameter of metal disc 64. Thin flexible adhesive tape 66 rigidly couples driver 52 to sound board 56. Tape 66 may be 3M Scotch™ tape or other thin flexible tape that causes minimal damping. As shown, piezoelectric driver 52 is of the unimorph type having a ceramic on only one side of metal disc 64, but using a bimorph driver having ceramic discs on both sides of a metal disc may also be utilized.

Referring now to FIG. 7 and 8, housing 60 comprises speaker subhousing 68 and electronics subhousing 70. Speaker subhousing 68 preferably comprises a thin narrow frame 72 extending around the periphery of speaker subhousing 68. A reinforcing spider 74 comprising a pair of thin narrow reinforcing cross bars **74*a*, 74*b* extends laterally from the sides of frame 72 to provide rigidity to housing 60**.

As shown in FIG. 9, there is a small gap 76 between reinforcing spider 74 and sound board 56, which allows sound board 56 with coupled piezoelectric driver 52 to vibrate freely while minimizing the damping thereof. Frame 72 has a recess or notch 73 for supporting the outer edge of sound board 56. Notch 73 is preferably step shaped and extends from the inside edge 78 and from back surface 80 of frame 72 to a depth equivalent to the thickness of sound board 56.

Referring again to FIGS. 7 and 8, electronics subhousing 70 comprises a rectangular aperture 82 for receiving printed circuit board 84 and a generally rectangular battery aperture 86 having a rounded inside edge for receiving battery 88. Voice chip 90 is mounted on printed circuit board 84 and is electrically connected to driver 52 with wires 89 which pass through channel 91 in housing 60. Snap switch 92 mounted on printed circuit board 84 activates voice chip 90. Battery 88 provides electrical power to printed circuit board 84 by means of spring loaded battery contacts 94. Battery cap 96 is a plastic plug which is shaped to fit in the mouth of battery aperture 97 along the bottom side edge 98 of housing 60. Thin flexible sheets 98 and 100 are adhesively affixed to the front surface 102 and back surface 80 of housing 60. Circuit board 84, battery aperture 86, battery cap 96, voice chip 90, snap switch 92 and flexible sheets 98, 100, are generally similar to like components of the embodiment shown in FIGS. 1–6.

In use, driver 52 vibrates with minimal damping, since there is air on both sides of driver 52. Further, sound board 56 coupled to driver 52 vibrates in unison therewith, moving a considerable volume of air. As a result, over one half of the surface area of trading card 50 acts as a sound generator. This arrangement provides increased sound volume and quality while retaining a slim profile for the trading card. This configuration also minimizes battery drain and manufacturing costs.

While the presently preferred embodiment utilizing a circular driver mounted within a sound board aperture having a diameter which is nominally the same as the outside diameter of the driver, it should be understood that the diameter of the driver could be smaller or larger than the aperture, as long as the driver is rigidly coupled to the sound board. Also, while the drawings depict the driver and sound board facing to the front of the card, and spider 74 to the rear, the positions of these elements could be reversed.

Further, while the subject invention has been illustrated and described with respect to sports trading cards, it is equally applicable to other types of collectible cards, such as cards pertaining to entertainment, politics, history, religion, nature and other applications.

Thus, while what is shown and described herein constitutes preferred embodiments of the subject invention, it should be understood that various changes can be made without departing from the subject invention, the scope of which is defined in the appended claims.

We claim:

1. A trading card capable of generating sounds, comprising:

(a) a thin housing having front and back surfaces;

(b) flexible sheets affixed to the front surface and to the back surface of the housing;

(c) sound generating means located in the housing for generating preselected patterns of sounds, including piezoelectric speaker means for receiving electrical signals and creating sound correlatable therewith, wherein the piezoelectric speaker means comprises a piezoelectric driver coupled to a sound board wherein the sound board comprises a stiff planar foam sheet having an aperture therein aligned with the piezoelectric driver;

(d) power means located in the housing for supplying electrical power to the sound generating means; and (e) activation means located in the housing for activating the sound generating means.

2. The trading card as defined in claim 1, wherein the diameter of the aperture is dimensioned to receive the piezoelectric driver therein.

3. The trading card as defined in claim 2, wherein the piezoelectric driver is coupled to the sound board by thin flexible adhesive tape.

4. The trading card as defined in claim 3, wherein the piezoelectric driver comprises a circular piezoelectric ceramic disk adhering to the surface of a thin metal disc.

5. The trading card as defined in claim 1, wherein the sound board is made from a material selected from a group of materials comprising polystyrene foam, urethane resin foam, urea resin foam and phenolic resin foam.

6. The trading card as defined in claim 1, wherein the housing comprises a speaker subhousing having sound board support means for supporting the sound board along the outer perimeter thereof.

7. The trading card as defined in claim 6, wherein the sound board support means comprises a thin frame.

8. The trading card as defined in claim 7, wherein the frame is provided with a notch along the inner edge thereof dimensioned for receiving the outer edge of the sound board.

9. The trading card as defined in claim 7, wherein the frame includes reinforcing means extending laterally therefrom for reinforcing the frame.

10. The trading card as defined in claim 9, wherein the reinforcing means comprises a pair of cross arms thinner than the frame and spaced from the sound board and piezoelectric driver.

11. The trading card defined in claim 6, wherein the housing also comprises an electronics subhousing having apertures therein for receiving components of the sound generating means, the power means and the activation means.

12. The trading card defined in claim 11, wherein the apertures in the electronics subhousing include a battery aperture which extends to an edge of the electronics subhousing.

13. The trading card defined in claim 12, wherein the power means comprises a thin replaceable battery dimensioned to fit into the battery aperture via a slot in the edge of the card, and a battery cap dimensioned to cover the edge portion of the battery aperture.

14. The trading card defined in claim 1, wherein the activation means comprises a switch located in an aperture in the housing at a preselected switch location, the switch being sandwiched between the flexible sheets.

15. The trading card defined in claim 14, wherein the switch is a snap switch comprising a resilient dome-shaped metal contact plate spaced from a flat metal contact plate, the dome-shaped contact plate being adapted to move towards and contact the flat contact plate when the flexible sheets are squeezed together at the preselected switch location.

16. The trading card defined in claim 1, wherein the sound generating means further comprises:

(a) storage means for storing digital signals representative of preselected patterns of sound; and (b) processing means for converting the stored digital signals into analogue electrical signals.

17. A trading card capable of generating sounds comprising:

(a) a thin housing having front and back surfaces, comprising a speaker subhousing having a thin frame extending around the periphery and having reinforcing cross bars extending laterally thereacross, and an electronics subhousing having a circuit board aperture and a battery aperture exiting to an edge thereof;

(b) flexible printed sheets adhesively affixed to the front and back surfaces;

(c) a voice chip mounted on a printed circuit board located in the circuit board aperture;

(d) piezoelectric speaker means located in the speaker subhousing comprising a sound board supported by the frame, and a piezoelectric driver located in an aperture in the sound board, the driver being coupled to the sound board with adhesive tape and electrically connected to the voice chip;

(e) a battery located in the battery aperture in the electronics subhousing supplying power to the voice chip;

(f) a battery cap dimensioned to fit in the battery aperture at the edge of the electronics subhousing; and (g) a snap switch located on the circuit board and sandwiched between the flexible sheets, which is adapted to activate the voice chip when the flexible sheets are squeezed together.

* * * * *